US009032762B2

(12) United States Patent
Begriche et al.

(10) Patent No.: US 9,032,762 B2
(45) Date of Patent: May 19, 2015

(54) FULLY INTEGRATED THREE-DIMENSIONAL TEXTILE ELECTRODES

(75) Inventors: Aldjia Begriche, Montreal (CA); Olivier Guy Robert Vermeersch, Saint-Hyacinthe (CA); Borislav Lyubomirov Tsvetanov, Greenfield Park (CA); Dominic Lachapelle, Saint-Hyacinthe (CA)

(73) Assignee: Groupe CTT Inc., St-Hyacinthe, Quebec (CA)

( * ) Notice: Subject to any disclaimer, the term of this patent is extended or adjusted under 35 U.S.C. 154(b) by 763 days.

(21) Appl. No.: 13/313,481

(22) Filed: Dec. 7, 2011

(65) Prior Publication Data

US 2012/0144561 A1 Jun. 14, 2012

Related U.S. Application Data

(60) Provisional application No. 61/420,812, filed on Dec. 8, 2010.

(51) Int. Cl.

| | |
|---|---|
| ***D04B 1/14*** | (2006.01) |
| ***D04B 1/22*** | (2006.01) |
| *A41D 1/00* | (2006.01) |

(52) U.S. Cl.

CPC ... *D04B 1/22* (2013.01); *D04B 1/14* (2013.01); *A41D 1/005* (2013.01); *A41D 2500/10* (2013.01); *D10B 2403/02431* (2013.01); *D10B 2403/0333* (2013.01); *D10B 2403/0114* (2013.01); *D10B 2403/0222* (2013.01)

(58) Field of Classification Search

CPC ..... D10B 2403/0333; D10B 2403/0114; D10B 2403/0222; D04B 1/14; D04B 1/16; D04B 1/22; A41D 1/005

USPC ..... 700/141; 66/170, 171, 196

See application file for complete search history.

(56) References Cited

U.S. PATENT DOCUMENTS

| | | | | | |
|---|---|---|---|---|---|
| 4,715,235 | A | * | 12/1987 | Fukui et al. | 73/862.68 |
| 4,729,377 | A | * | 3/1988 | Granek et al. | 600/393 |
| 4,753,088 | A | * | 6/1988 | Harrison et al. | 66/202 |
| 5,635,909 | A | | 6/1997 | Cole | |
| 6,145,551 | A | * | 11/2000 | Jayaraman et al. | 139/387 R |

(Continued)

FOREIGN PATENT DOCUMENTS

| | | |
|---|---|---|
| AU | 2008203307 | 8/2008 |
| EP | 1506738 | 2/2005 |

(Continued)

*Primary Examiner* — Danny Worrell

(74) *Attorney, Agent, or Firm* — Norton Rose Fulbright Canada LLP

(57) ABSTRACT

There is described herein a knitting technique for creating a garment having one or more 3D textile electrodes integrated therein. The knitting technique involves knitting the item with integrated electrodes and transmission channels in one single step. The electrode is knit using conducting thread while a base fabric is knit using non-conducting thread. The electrode is knit on a first needle bed and the base fabric is knit on a second needle bed opposite to and facing the first needle bed, the two needle beds being separated by a few millimeters. During the knitting process, the surface knit on the first needle bed and the surface knit on the second needle bed may be linked using an isolating thread network that is simply deposited, without forming a mesh, on the fabric, in order to provide the three-dimensional effect.

21 Claims, 9 Drawing Sheets

(56) References Cited

U.S. PATENT DOCUMENTS

| | | | | |
|---|---|---|---|---|
| 6,210,771 | B1 * | 4/2001 | Post et al. | 428/100 |
| 6,315,009 | B1 | 11/2001 | Jayaraman et al. | |
| 6,341,504 | B1 * | 1/2002 | Istook | 66/172 E |
| 6,381,482 | B1 * | 4/2002 | Jayaraman et al. | 600/388 |
| 6,474,367 | B1 | 11/2002 | Jayaraman et al. | |
| 6,589,171 | B2 | 7/2003 | Keirsbilck | |
| 6,608,438 | B2 * | 8/2003 | Topelberg et al. | 313/511 |
| 6,687,523 | B1 * | 2/2004 | Jayaramen et al. | 600/388 |
| 6,854,296 | B1 * | 2/2005 | Miller, III | 66/190 |
| 6,915,668 | B2 * | 7/2005 | Huang et al. | 66/171 |
| 6,941,775 | B2 * | 9/2005 | Sharma | 66/202 |
| 6,970,731 | B1 * | 11/2005 | Jayaraman et al. | 600/388 |
| 7,145,432 | B2 * | 12/2006 | Lussey et al. | 338/47 |
| 7,308,294 | B2 * | 12/2007 | Hassonjee et al. | 600/386 |
| 7,324,841 | B2 * | 1/2008 | Reho et al. | 600/382 |
| 7,426,872 | B2 * | 9/2008 | Dittmar et al. | 73/818 |
| 7,468,332 | B2 | 12/2008 | Avloni | |
| 7,474,910 | B2 * | 1/2009 | Hassonjee et al. | 600/395 |
| 7,501,069 | B2 | 3/2009 | Liu et al. | |
| 7,522,951 | B2 * | 4/2009 | Gough et al. | 600/388 |
| 7,559,902 | B2 * | 7/2009 | Ting et al. | 600/529 |
| 7,779,656 | B2 * | 8/2010 | Dias et al. | 66/202 |
| 7,783,334 | B2 * | 8/2010 | Nam et al. | 600/388 |
| 7,870,761 | B2 * | 1/2011 | Valentine et al. | 66/171 |
| 7,878,030 | B2 * | 2/2011 | Burr | 66/173 |
| 7,966,052 | B2 * | 6/2011 | DeFusco et al. | 600/386 |
| 7,970,451 | B2 * | 6/2011 | Hassonjee et al. | 600/395 |
| 8,032,199 | B2 * | 10/2011 | Linti et al. | 600/388 |
| 8,050,733 | B2 * | 11/2011 | Rytky | 600/388 |
| 8,082,762 | B2 * | 12/2011 | Burr | 66/175 |
| 8,116,898 | B2 * | 2/2012 | Chung et al. | 700/141 |
| 8,171,755 | B2 * | 5/2012 | Jahn et al. | 66/177 |
| 8,443,634 | B2 * | 5/2013 | Scheffler et al. | 66/170 |
| 8,476,172 | B2 * | 7/2013 | Christof | 442/304 |
| 8,600,486 | B2 * | 12/2013 | Kaib et al. | 600/509 |
| 8,684,924 | B2 * | 4/2014 | Ouwerkerk et al. | 600/301 |
| 8,732,866 | B2 * | 5/2014 | Genz et al. | 2/244 |
| 8,818,478 | B2 * | 8/2014 | Scheffler et al. | 600/388 |
| 2002/0082491 | A1 | 6/2002 | Nissila | |
| 2002/0126100 | A1 | 9/2002 | Sandbach | |
| 2003/0212319 | A1 | 11/2003 | Magill | |
| 2005/0034485 | A1 * | 2/2005 | Klefstad-Sillonville et al. | 66/171 |
| 2005/0131489 | A1 | 6/2005 | Gardon-Mollard | |
| 2007/0028814 | A1 | 2/2007 | Swistak et al. | |
| 2007/0028821 | A1 | 2/2007 | Bennett et al. | |
| 2007/0078324 | A1 | 4/2007 | Wijisiriwardana | |
| 2007/0083096 | A1 * | 4/2007 | Paradiso | 600/388 |
| 2008/0015454 | A1 | 1/2008 | Gal | |
| 2008/0045808 | A1 | 2/2008 | Hassonjee et al. | |
| 2008/0064970 | A1 | 3/2008 | Montplaisir | |
| 2008/0075850 | A1 | 3/2008 | Rock | |
| 2008/0091097 | A1 | 4/2008 | Linti et al. | |
| 2008/0143080 | A1 | 6/2008 | Burr | |
| 2008/0183063 | A1 | 7/2008 | Tang et al. | |
| 2009/0018428 | A1 * | 1/2009 | Dias et al. | 600/388 |
| 2009/0203984 | A1 * | 8/2009 | Dias et al. | 600/388 |
| 2009/0227856 | A1 | 9/2009 | Russell et al. | |
| 2010/0041974 | A1 | 2/2010 | Ting et al. | |
| 2010/0070008 | A1 * | 3/2010 | Parker et al. | 607/116 |
| 2010/0113910 | A1 | 5/2010 | Brauers et al. | |
| 2010/0137702 | A1 | 6/2010 | Park et al. | |
| 2011/0030127 | A1 * | 2/2011 | Dias et al. | 2/311 |
| 2012/0144561 | A1 * | 6/2012 | Begriche et al. | 2/243.1 |
| 2012/0233751 | A1 * | 9/2012 | Hexels | 2/463 |
| 2013/0116532 | A1 * | 5/2013 | Brunner et al. | 600/390 |
| 2013/0274587 | A1 * | 10/2013 | Coza et al. | 600/409 |
| 2013/0319054 | A1 * | 12/2013 | Asiaghi | 66/174 |
| 2014/0150573 | A1 * | 6/2014 | Cannard et al. | 73/862.627 |

FOREIGN PATENT DOCUMENTS

| | | |
|---|---|---|
| EP | 2138965 | 12/2009 |
| EP | 2143376 | 1/2010 |
| GB | 2350193 | 11/2000 |
| GB | 2415051 | 12/2005 |
| GB | 2444145 | 5/2008 |
| WO | WO01/02052 | 1/2001 |
| WO | WO03/094717 | 11/2003 |
| WO | WO2005/053532 | 6/2005 |
| WO | WO2007/050650 | 5/2007 |
| WO | WO2007/126435 | 11/2007 |
| WO | WO2008/155184 | 12/2008 |
| WO | WO2009/107939 | 9/2009 |

* cited by examiner

FULLY INTEGRATED THREE-DIMENSIONAL TEXTILE ELECTRODES

CROSS-REFERENCE TO RELATED APPLICATIONS

This application claims priority under 35 USC §119(e) from provisional patent application No. 61/420,812 filed on Dec. 8, 2010 and herewith incorporated in its entirety.

TECHNICAL FIELD

The present invention relates to the field of textile articles having electrically conductive portions integrated therein.

BACKGROUND OF THE ART

A textile is a flexible material consisting of a network of natural or artificial fibres often referred to as thread or yarn. Textiles are formed by weaving, knitting, crocheting, knotting, or pressing fibres together. Textile products may be prepared from a number of combinations of fibers, yarns, films, sheets, foams, furs, or leather. They are found in apparel, household and commercial furnishings, vehicles, and industrial products.

New textile materials, miniaturization of electrical components and other technical developments have enabled the integration of wires and electronics into clothing in order to create intelligent garments. In intelligent garments, sensors and other components, such as simple processing elements, are integrated into the fabric. The garments may be composed of conductive fibers and other materials, such as piezoresistive and piezoelectric polymers, and are useful for different applications in human monitoring. Garments made of such textiles can be used for monitoring body movements and postures, and also for monitoring vital functions, including heart rate and skin temperatures. Intelligent garments can also be used for measuring electrical muscle activity.

The possible applications for intelligent garments are wide ranging, from sports and healthcare to hazardous environments and military. Therefore, there is a need to improve the existing technology in this area.

SUMMARY

There is described herein a knitting technique for creating a garment having one or more 3D textile electrodes integrated therein. The knitting technique involves knitting the item with integrated electrodes and transmission channels in one single step. The electrode is knit using conducting thread while a base fabric is knit using non-conducting thread. The electrode is knit on a first needle bed and the base fabric is knit on a second needle bed opposite to and facing the first needle bed, the two needle beds being separated by a few millimeters. During the knitting process, the surface knit on the first needle bed and the surface knit on the second needle bed may be linked using an isolating thread network that is simply deposited, without forming a mesh, on the fabric, in order to provide the three-dimensional effect.

In accordance with a first broad aspect, there is provided a method for knitting a garment having at least one three-dimensional textile electrode integrated therein, the method comprising: knitting at least one tubular form; knitting the at least one three-dimensional textile electrode integrally within the at least one tubular form by: knitting a conductive surface composed of conductive thread; knitting an isolating surface composed of isolating thread; filling a space between the conductive surface and the isolating surface; and sealing the electrode by connecting the conductive surface and the isolating surface together along a perimeter thereof; and knitting a textile transmission channel extending from the at least one three-dimensional textile electrode to transmit a measured signal.

There is also described herein a 3D textile electrode. The architecture of the electrode corresponds to a three-dimensional shape entirely made of thread, using a combination of conductive and non-conductive thread. A pillow-like shape is formed with two opposing faces, the one in contact with the skin of the wearer being conductive while the one facing outwards being non-conductive. The two faces are attached together along all four sides and an isolating thread network is used to hold the three-dimensional shape by separating the two opposing faces inside the pillow-shaped structure. A transmission channel is formed using a tube-like structure made from non-conductive thread and a single conducting thread (that is also used for the electrode) passing through the tube-like structure.

In accordance with a second broad aspect, there is provided a garment having at least one three-dimensional textile electrode integrated therein, the garment comprising: a base portion composed of at least one type of base thread; at least one electrode portion defined by a perimeter and comprising: a conductive surface on an inside of the garment for contact with skin of a wearer, the conductive surface composed of conductive thread; an isolating surface on an outside of the garment composed of isolating thread; and an isolating thread network inside a space between the conductive surface and the isolating surface, the conductive surface and the isolating surface being sealed along the perimeter of the electrode portion; and a textile transmission channel extending from the at least one electrode portion to transmit a measured signal.

In accordance with yet another broad aspect, there is provided a computer readable medium comprising computer executable instructions for carrying out a method for knitting a garment having at least one three-dimensional textile electrode integrated therein, the method comprising: instructing selected needles in a first needle bed and a second needle bed to knit at least one tubular form; instructing selected needles in the first needle bed and the second needle bed to knit the at least one three-dimensional textile electrode integrally within the at least one tubular form by: knitting a conductive surface composed of conductive thread using the first needle bed; knitting an isolating surface composed of isolating thread using the second needle bed; filling a space between the conductive surface and the isolating surface using a combination of the first needle bed and the second needle bed; and sealing the electrode by connecting the conductive surface and the isolating surface together along a perimeter of the electrode; and instructing selected needles in the first needle bed and the second needle bed to knit a textile transmission channel extending from the at least one three-dimensional textile electrode to transmit a measured signal.

In this specification, the term fabric is intended to mean a thin, flexible material made of any combination of cloth, fiber, or polymer (film, sheet, or foams). Cloth is intended to mean a thin, flexible material made from yarns. Yarn is intended to mean a continuous strand of fibers. Fiber is intended to mean a fine, rod-like object in which the length is greater than 100 times the diameter.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
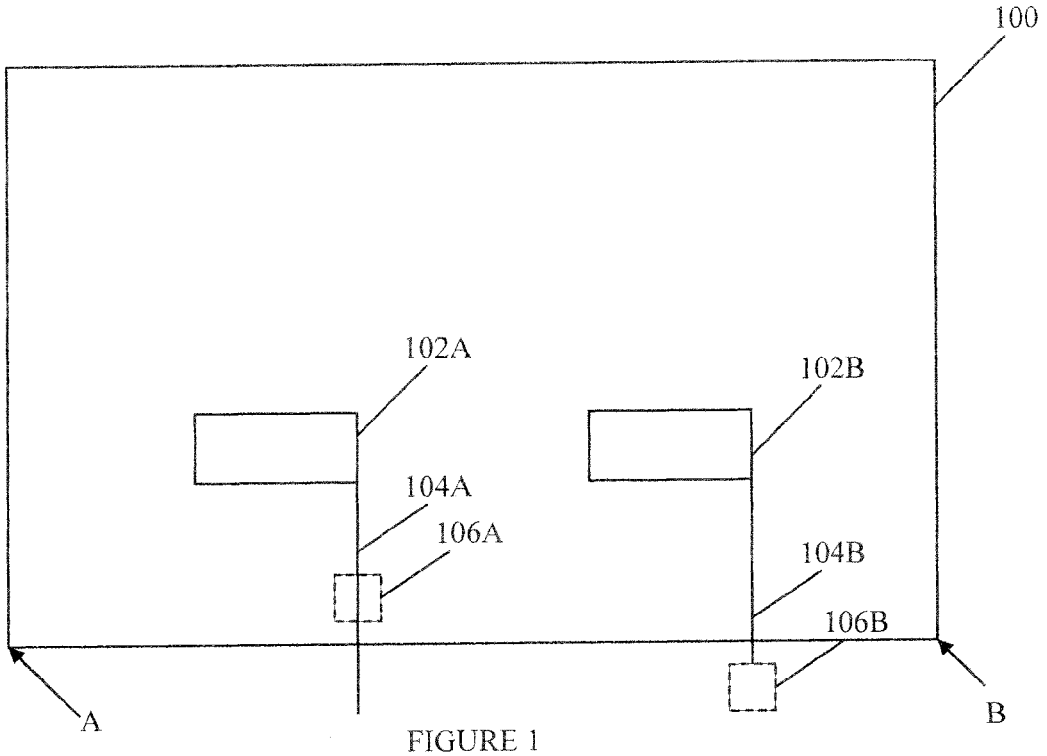
FIG. 1 is a front view of a garment having two 3D textile electrodes integrated therein, in accordance with one embodiment.

FIG. 1 illustrates a garment 100 having two electrodes 102*a*, 102*b* integrated therein. The garment 100 may be any wearable textile-based clothing, such as a sweater, pants, underwear, socks, camisoles, mittens, a t-shirt, shorts, a vest, a jacket, a brassiere, or any other article of clothing. The garment 100 may also be an arbitrarily-shaped piece of fabric that is attached to the body using any type of fastening means, such as one or more straps, buttons, clips, pins, hook and loops (Velcro™), and a combination thereof. The fastening means may be independent from the garment or they may be an integral part thereof. The garment can be located or fastened on any parts of the body, such as, for example, the back, the torso, the head, the neck, the thigh, the foot, etc.

The electrodes 102*a*, 102*b*, are three-dimensional textile structures. They may be used to capture electrical activity from the body of a wearer of the garment. The garment may be worn by a mammal (such as a human) as well as an animal (such as a dog). In particular, the electrodes may be used for monitoring vital functions, including heart rate, muscle contraction and/or neuronal activity, and for measuring electrical muscle activity and/or electrical neuronal activity. In one embodiment, the electrodes 102*a*, 102*b* are used to measure the electrical activity of the heart by detecting and amplifying electrical modulations occurring in the skin that are caused when the heart muscle depolarizes during each heart beat. Alternatively or in combination, the electrodes 102*a*, 102*b* can be used to measure the electrical activity of a muscle (smooth or skeletal) by detecting and amplifying electrical modulations occurring in the skin that are associated with the muscle's depolarization upon contraction.

The electrodes 102*a*, 102*b* can also be used to capture electrical activity from the neurons of a wearer of the garment. In particular, they may be used for monitoring cerebral functions, including spontaneous electrical activity of the brain's neurons. In one embodiment, the electrodes 102*a*, 102*b* are used to measure the electrical activity associated with the neurons (e.g. ionic current flow) by detecting and amplifying electrical modulations occurring in the scalp that are associated with neuronal activity, especially the ion flow between neurons.

The shape, thickness and size of the electrodes 102*a*, 102*b* can very depending on the intended use. In an embodiment, the electrodes may be of a rectangular, triangular, circular, oval and/or irregular shape. The shape of each electrode may be the same or different. In another embodiment, the thickness of each electrode may be the same or different. In yet another embodiment, the size of each electrode may be the same or different.

More than two electrodes 102*a*, 102*b* may be present in the garment 100 in order to measure the electrical activity of the body. A reference electrode may be provided with a pair of electrodes. Alternatively, a plurality of electrodes are provided in pairs and each pair acts as a "lead" in order to provide information on the muscle or neurons from a different angle. The garment may therefore act as a 3-lead, 5-lead, or 12-lead Electrocardiography (ECG) recorder. The garment may also act as a 3-lead, 5-lead or 12-lead Electromyography (EMG) recorder. The garment may also act as 3-lead, 5-lead or 12-lead Electroencephalography (EEG) recorder. Other configurations of electrodes in the garment 100 will be readily apparent to those skilled in the art.

A transmission channel 104*a*, 104*b* is used to transport the electrical signal measured by each electrode 102*a*, 102*b* respectively, to a device 106*a* or 106*b* capable of interpreting the signal. The device 106*a*, 106*b* may be integrated in the garment 100, as shown by 106*a*, or may be outside of the garment 100, as shown by 106*b*. If outside of the garment 100, the transmission channel 104*b* is drawn from the electrode 102*b* to the edge of the garment 100 and extends outside of the garment 100 in order to connect to an external device 106*b*. The device 106*a* may be a microprocessor that interprets the data received by the electrode 102*a* and transmits interpreted data wirelessly such that it may be read by medical personnel. The device 106*b* may be an ECG, EEG or EMG machine or may be a subcomponent of such a machine used to interpret the data which then sends it to another subcomponent of the machine.

Figure 2A:
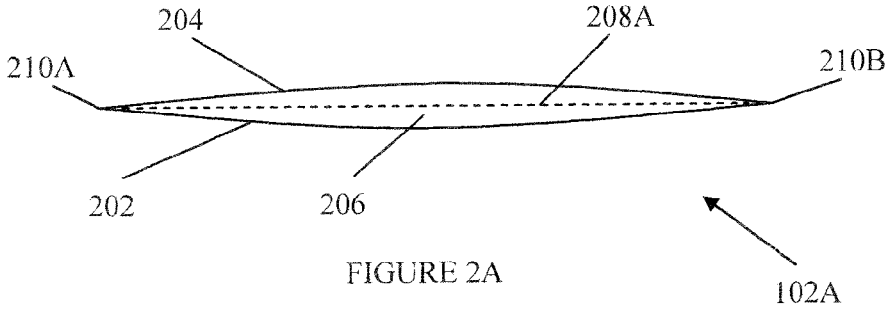
FIG. 2*a* is a top view of a single electrode, in accordance with one embodiment.

FIG. 2*a* is a top view of electrode 102*a*. Electrode 102*b* has a similar structure and will not be illustrated in detail. The structure of the electrode 102*a* is three-dimensional and is formed by two surfaces. A first surface 204 is a conductive surface and it is in direct contact with the skin or scalp of the wearer when the garment 100 is being worn. Surface 204 is made of conductive thread. The conductive thread may consist of a non-conductive or less conductive substrate, which is then either coated or embedded with electrically conductive elements, such as carbon, nickel, copper, gold, silver, and/or titanium. Substrates may include cotton, polyester, and/or nylon. Various commercially-available conductive threads having varying resistances and thread tucks may be used.

Surface 202 is an isolating surface made from an isolating thread, such as cotton, polyester and/or nylon. Surface 202 is outwardly facing when the garment is worn by the user and may be composed of the same thread as the remainder of the garment. In this embodiment, the electrodes 102*a*, 102*b* are not visible when the garment is worn as the conductive surface 204 is only present on the inside and not on the outside and the isolating surface blends-in with the rest of the garment.

Figure 2B:
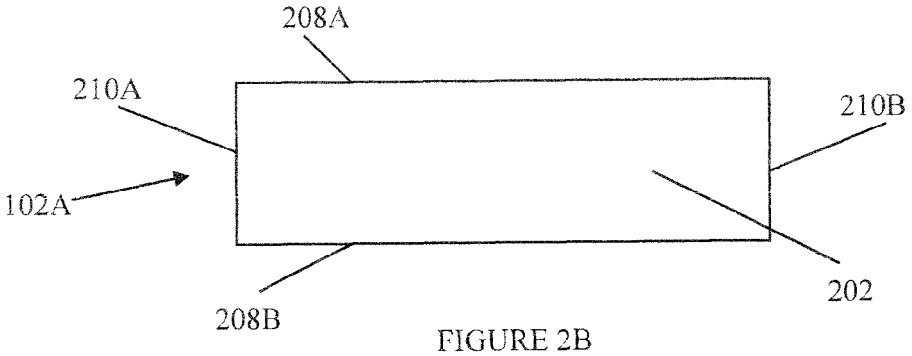
FIG. 2*b* is a front view of the single electrode of FIG. 2*a*, in accordance with one embodiment.

As shown on FIG. 2*b*, surfaces 202 and 204 are connected together along four edges 208*a*, 208*b*, 210*a*, 210*b*. The top and bottom of the electrode 102*a* are sealed along top edge 208*a* and bottom edge 208*b*, while left and right sides of the electrode 102*a* are sealed along left edge 210*a* and right edge 210*b*. A pillow-like structure is therefore formed. Sealing is done using various stitching techniques, as will be described below.

Figure 2C:
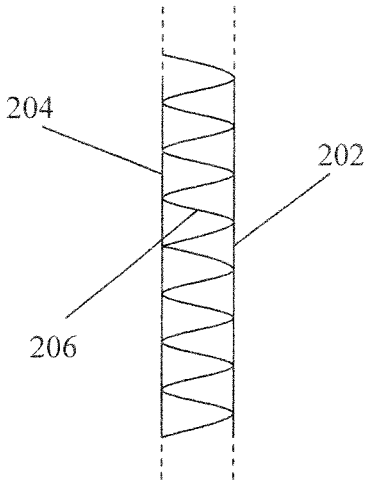
FIG. 2*c* is a side cross-sectional view of part of the single electrode of FIG. 2*b*, in accordance with one embodiment.

In order to provide support to the 3D structure, the space provided between the conductive surface 204 and the isolating surface 202 is filled with an isolating thread network 206. In one embodiment, the thread network is a monofilament yarn that goes from edge 210*a* to edge 210*b*, and from edge 208*a* to edge 208*b*. In some embodiments, an isolating thread is not stitched with the inside and outside surfaces 202, 204 but simply deposited using a tucking operation. FIG. 2*c* is an exemplary embodiment illustrating the thread network 206 provided between the conductive surface 204 and the isolating surface 202. In another embodiment, more than one thread is used to isolate the conductive surface 204 from the isolating surface 202, using a similar tucking operation to provide filler to the 3D structure.

The thickness of the electrode 102*a* is dependent on the amount of isolating thread network provided between the conductive surface 204 and the isolating surface 202. The three-dimensional nature of the electrode 102*a* provides better stability, even when the garment is stretched. This leads to a more optimal contact with the skin of the wearer when the garment is worn, thereby reducing the occurrence of interference signals.

Figure 3:
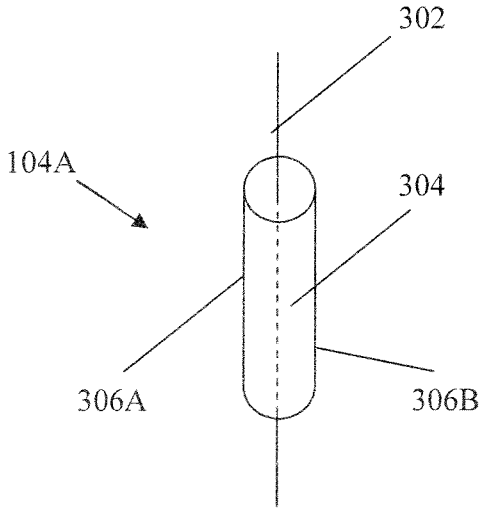
FIG. 3 is an enlarged view of a transmission channel, in accordance with one embodiment.

FIG. 3 is an enlarged view of the transmission channel 104*a*. Transmission channel 104*b* has a similar structure and will not be illustrated in detail. The transmission channel 104*a* is composed of two elements, namely a conductive thread 302 extending from the electrode 102*a* and a textile channel 304 isolating the conductive thread from the wearer's body and the exterior. The textile channel 304 is tube-like and may be formed using the same material as the non-conductive areas of the garment 100. The conductive thread 302 is enclosed by the textile channel 304 and is independent therefrom. The textile channel 304 may be formed similarly to the electrodes 102*a*, 102*b*, i.e. by connecting two opposing surfaces together along a pair of edges 306*a*, 306*b*. The top and bottom ends of the formed channel 304 may be left open, the top end receiving the conductive thread 302 and the bottom end allowing the conductive thread 302 to exit. The conductive thread 302 may be stitched on itself to give it more strength. If left open, the bottom end is knit in a way to ensure that the garment 100 does not unravel. Alternatively, the bottom end of the formed channel 304 is closed.

It will be understood that the electrodes 102*a*, 102*b*, may be of alternative shapes, such as circular, oval, square, triangular, etc. For any shape provided, two surfaces, one conductive and one isolating, are attached together along an outer perimeter in order to form a pillow-like structure, with a thread network provided inside to give support and strength to the three-dimensional textile electrode.

The garment illustrated in FIG. 1 with the integrated electrodes may be made using a variety of techniques, such as knitting weft/warp or circular type, weaving, and embroidery on a textile substrate. They may be made using fully fashion techniques on flatbed machines or using alternative techniques known by those skilled in the art, such as cut and sew.

Figure 4:
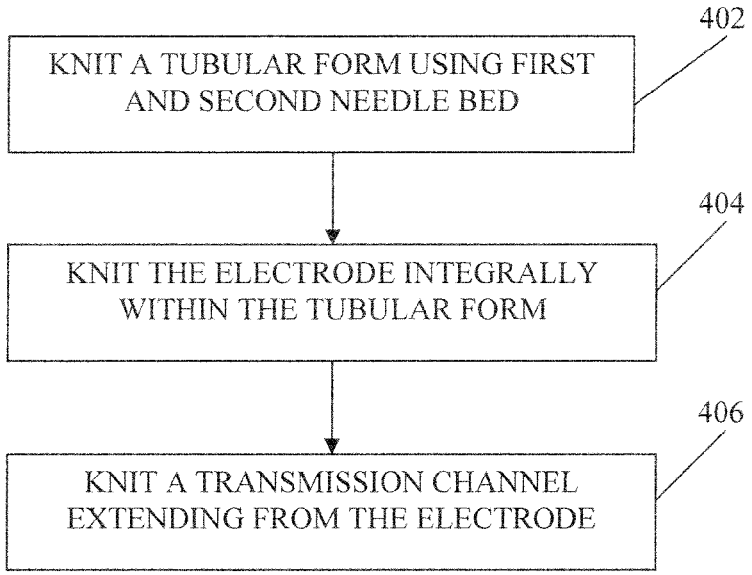
FIG. 4 is a flowchart illustrating an exemplary method for knitting a garment having at least one three-dimensional textile electrode integrated therein.

FIG. 4 illustrates one embodiment for making the garment 100 with at least one three-dimensional textile electrode integrated therein. In this example, a flatbed machine is used, the machine having straight needle beds carrying independently operated needles of the latch type. A carriage having cam boxes travels along the beds forcing the needle butts in its way to follow a curved shape of the cam. The latch needle, composed of a needle hook, a latch, and a needle stem, controls a loop so that individual movement and control of the needle permits loop selection to be accomplished. The method will be described for a V-bed flat machine.

In a first step, at least one tubular form is knit using the first and second needle beds 402. The first and second needle beds may be called a front needle bed and a back needle bed. The tubular form is created on both needle beds but front and back bed knitting are done alternately. The continuously alternate knitting of all needles on the front and back needle beds creates a single plain tube. Multiple tubes may be created and connected together to make a specific type of garment, such as a sweater, and the dimensions of the various tubes may be increased or decreased to form the body and/or sleeves of the sweater.

While the one or more tubular forms are being knit using the front and back needle beds, at least one electrode is also knit integrally within the tubular form 404. This is done as the knitting progresses from bottom to top of the garment. Similarly, a transmission channel is also knit integrally within the tubular form 406 as the knitting progresses. Referring back to FIG. 1, knitting will begin on the lower left hand corner of the garment, at point A. The garment 100 is knit row by row, from bottom to top. After having completed a first row from point A to point B, the machine moves up one row and repeats the process, either in the same direction (i.e. from A to B) or in the reverse direction (i.e. from B to A). When reaching a position on the garment where either a transmission channel 104*a*, 104*b*, or an electrode 102*a*, 102*b* is present, needle selection and thread selection is changed in order to perform one or more stitches that correspond to the appropriate portion of the garment 100.

Figure 5:
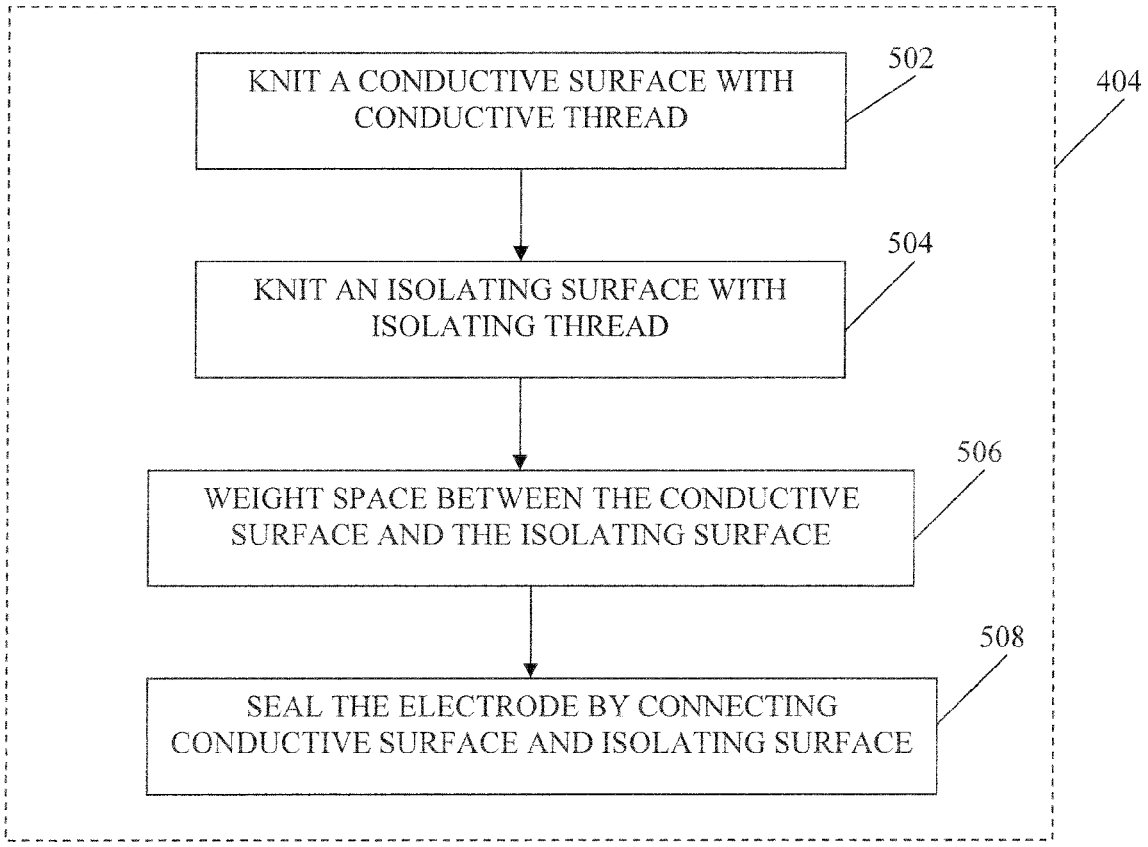
FIG. 5 is a flowchart illustrating an exemplary method for integrating the electrode in the garment.

FIG. 5 illustrates an exemplary embodiment for knitting the electrode. The conductive surface 204 illustrated in FIG. 2*c* is knit using the back needle bed 502 while the isolating surface 202 is knit using the front needle bed 504. Conductive thread is provided to the back needle bed while isolating thread is provided to the front needle bed, and a row of the conductive surface is knit simultaneously with a row of the isolating surface. Also simultaneously, the thread network is provided in the space between the conductive surface 204 and the isolating surface 202 using a tucking technique. Various transfer steps are used to perform the three steps simultaneously with only two needle beds, as will be described in more detail below. The electrode is sealed by connecting the conductive surface and the isolating surface together around the entire perimeter of both surfaces 508.

Figure 6:
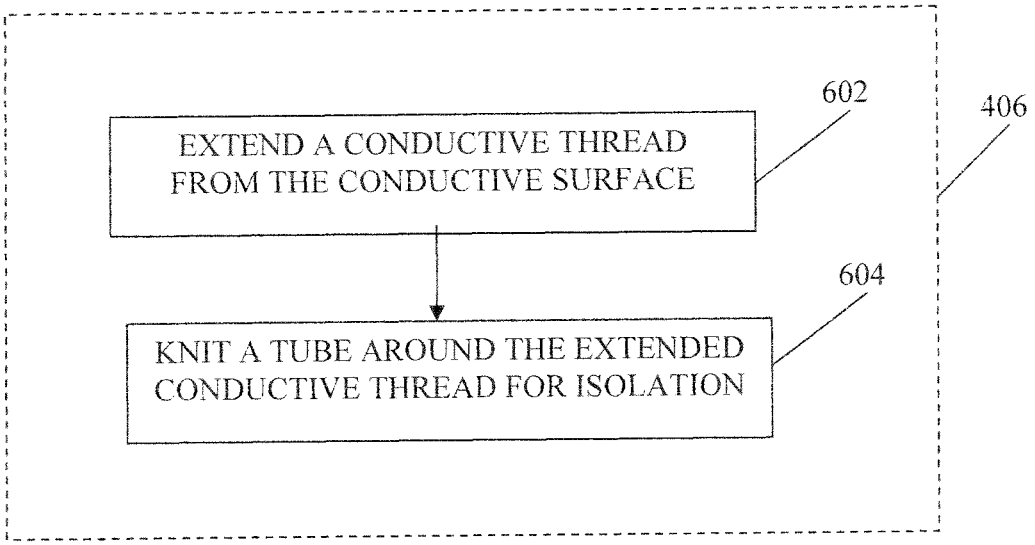
FIG. 6 is a flowchart illustrating an exemplary method for knitting a transmission channel.

FIG. 6 illustrates an exemplary embodiment for knitting the transmission channel. A single conductive thread, which may be stitched on itself, forms the inside part of the conductive channel 602 while a tube is knit around the conductive thread for isolation 604.

Therefore, as the garment is being knit, anyone of three portions may be knit at any one time. A first portion is the base of the garment, a second portion is the electrode portion, and a third portion is the transmission channel. The electrode portion includes the two conductive surfaces, the thread network, and the seal around the electrode at a boundary between the electrode and the base garment. The transmission channel includes the single conductive thread and the isolating tube around the single conductive thread.

Figure 7:
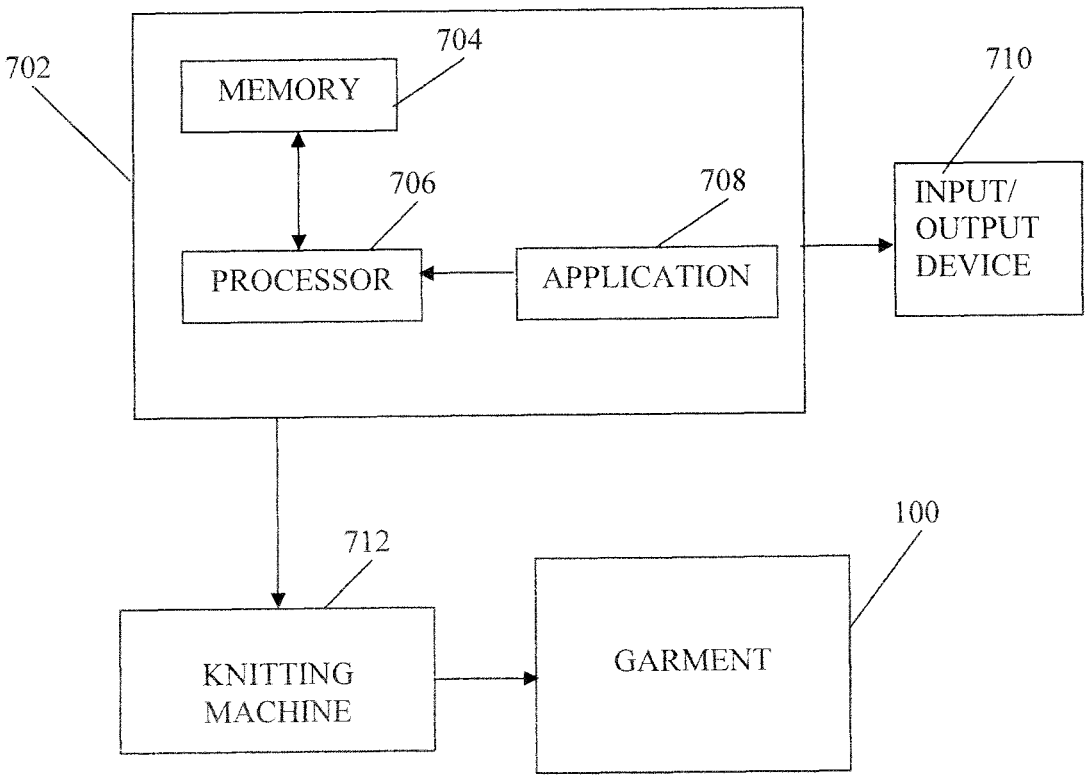
FIG. 7 is a block diagram illustrating an exemplary system for knitting a garment having at least one three-dimensional textile electrode integrated therein.

FIG. 7 illustrates an exemplary embodiment for a garment knitting system. A computer system 702 comprises an application 708 running on a processor 706, the processor being coupled to a memory 704. A knitting machine 712 and an input/output device 710 are connected to the computer system 702.

The memory 704 accessible by the processor 706 receives and stores data, such as instructions for creating a specific garment having a given number of electrodes, positioned at a predetermined position on the garment, and having a given size. Other information used by the garment knitting system, such as thread selection, may also be stored therein. The memory 704 may be a main memory, such as a high speed Random Access Memory (RAM), or an auxiliary storage unit, such as a hard disk, a floppy disk, or a magnetic tape drive. The memory may be any other type of memory, such as a Read-Only Memory (ROM), or optical storage media such as a videodisc and a compact disc.

The processor 706 may access the memory 704 to retrieve data. The processor 706 may be any device that can perform operations on data. Examples are a central processing unit (CPU), a front-end processor, a microprocessor, a graphics processing unit (GPU/VPU), a physics processing unit (PPU), a digital signal processor, and a network processor. The application 708 is coupled to the processor 706 and configured to perform various tasks as explained below in more detail. An output may be transmitted to the output device 710, which can also serve as an input device for setting various parameters of the system.

In one embodiment, the computer system 702 is integrated directly into the knitting machine 712 while in another embodiment, the computer system 702 is external to the knitting machine 712. The knitting machine 712 and the computer system 702 may communicate in a wired or wireless manner.

The knitting machine 712 may be a V-bed flat knitting machine, or a circular knitting machine.

While illustrated in the block diagram of FIG. 7 as groups of discrete components communicating with each other via distinct data signal connections, it will be understood by those skilled in the art that the present embodiments are provided by a combination of hardware and software components, with some components being implemented by a given function or operation of a hardware or software system, and many of the data paths illustrated being implemented by data communication within a computer application or operating system. The structure illustrated is thus provided for efficiency of teaching the present embodiment.

Figure 8A:
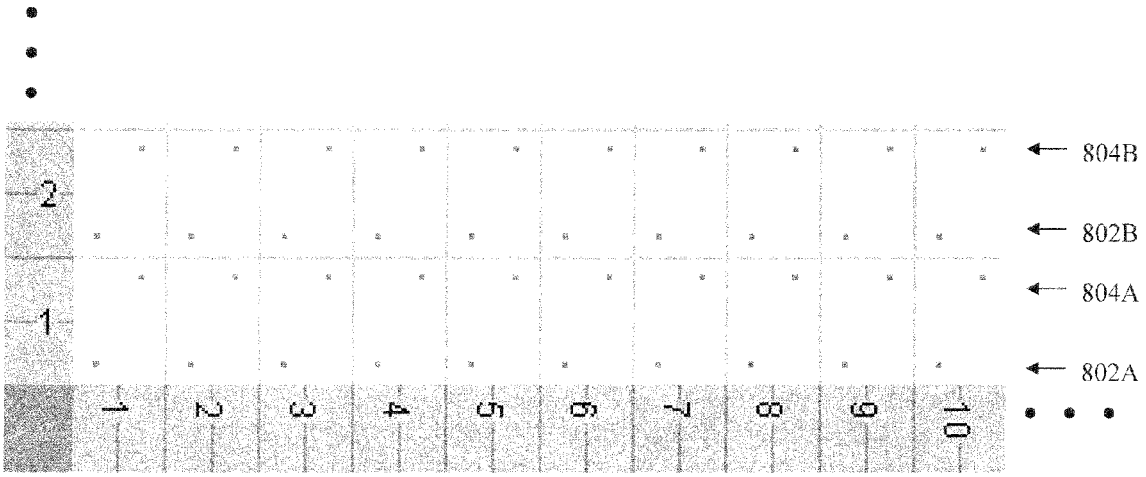
FIG. 8*a* is a top view of a schematic representation of a knitting field using a V-bed flat knitting machine.
Figure 8B:
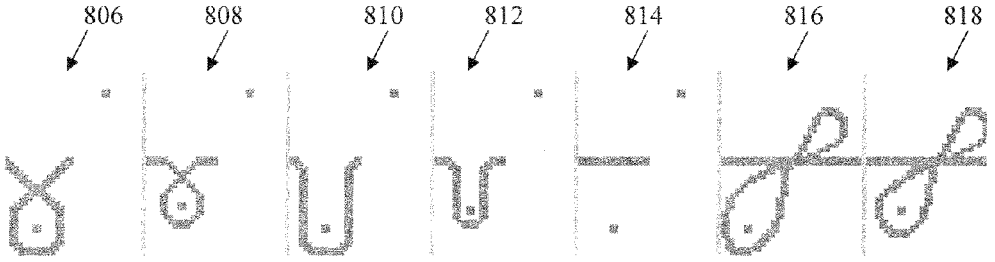
FIG. 8*b* illustrates possible stitches available using the V-bed flat knitting machine.
Figure 8C:
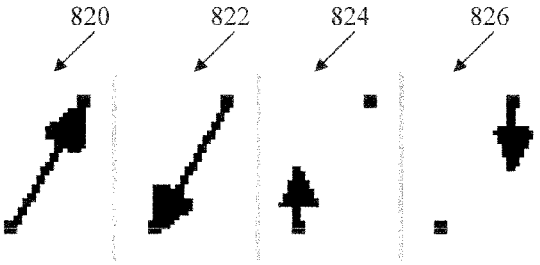
FIG. 8*c* illustrates possible needle functions available using the V-bed flat knitting machine.

FIG. 8*a* is a schematic top view of the knitting field using a V-bed flat knitting machine. The horizontal axis represents pairs of needles, while the vertical axis represents rows being knit. Each row has a front needle bed 802*a*, 802*b*, etc and a back needle bed 804*a*, 804*b*, etc. The front and back needle beds are slightly offset from each other. FIG. 8*b* illustrates possible stitches available on the machine: front needle stitch 806, small front needle stitch 808, front needle tuck 810, small front needle tuck 812, needle at rest 814, split 816, small split 818. While represented on the front needle bed, all of these stitches are also available on the back needle bed. FIG. 8*c* illustrates movements available for the needles, in addition to the stitches illustrated in FIG. 8*b*. Front to back transfer 820 and back to front transfer 822 allow displacement of the stitch to free a given needle. This is used, for example, when knitting the transmission channel. Front pull towards bottom 824 and back pull towards bottom 826 are used to free a stitch in order to increase thread feed and reduce the tension on the thread.

Figure 9:
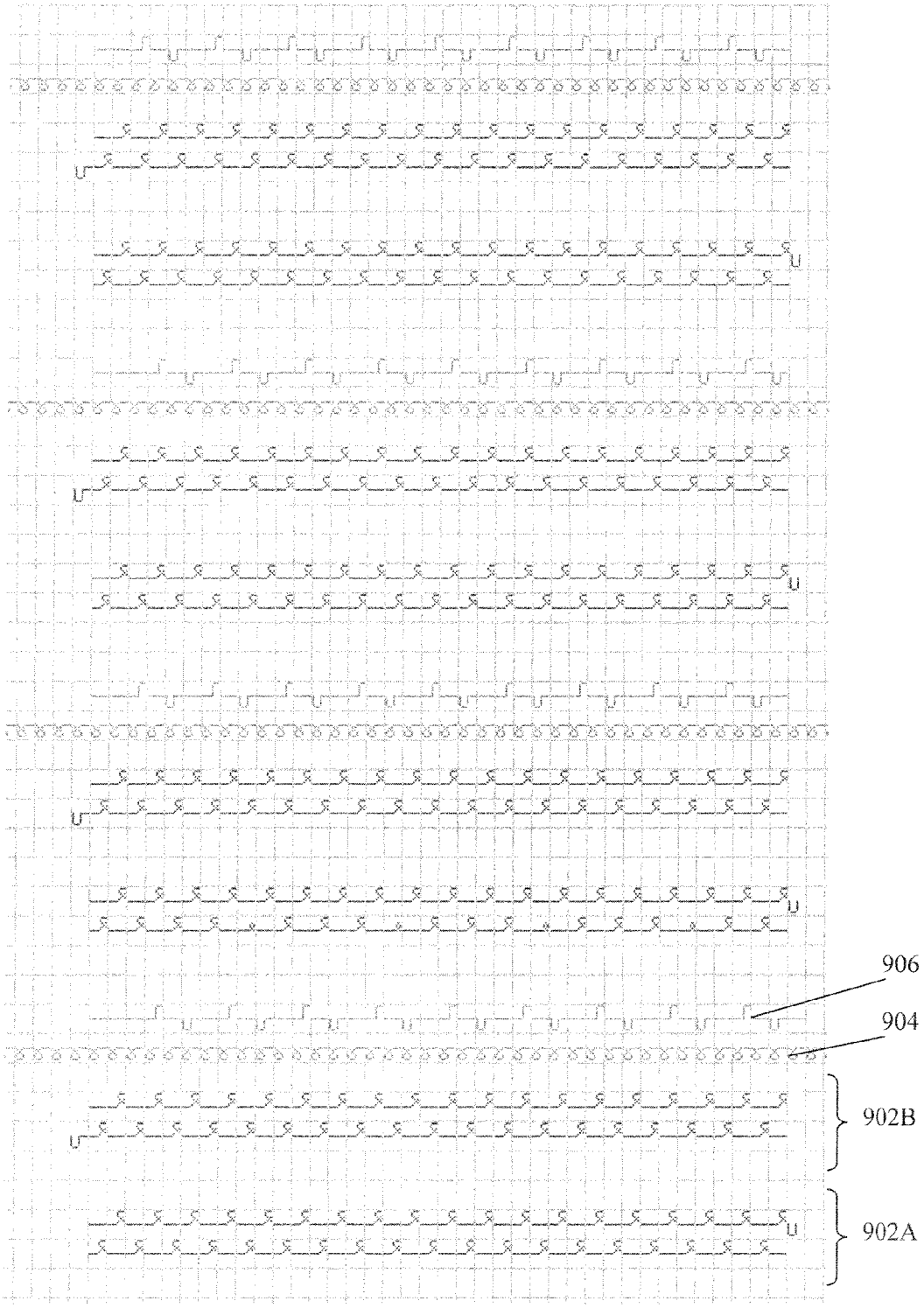
FIG. 9 is an exemplary schematic representation of a knitting sequence for a 3D textile electrode.

FIG. 9 illustrates a knitting sequence for an electrode. A three event pattern is repeated as the garment is progressively knit. A first event concerns two sets of rows representing the conductive surface of the electrode. As shown, a set of needles in the back row needle bed are instructed to perform a back needle stitch along the row using the conductive thread 902*a*, 902*b*. These instructions are repeated for two sets of two rows. A second event corresponds to a sequence of front needle stitches using the isolating thread along the front needle bed 904. The third event corresponds to a sequence of front and back needle tucks using the thread network 906. The three events 902*a*, 902*b*, 904, 906 are repeated upwardly, as illustrated in FIG. 9.

Figure 10:
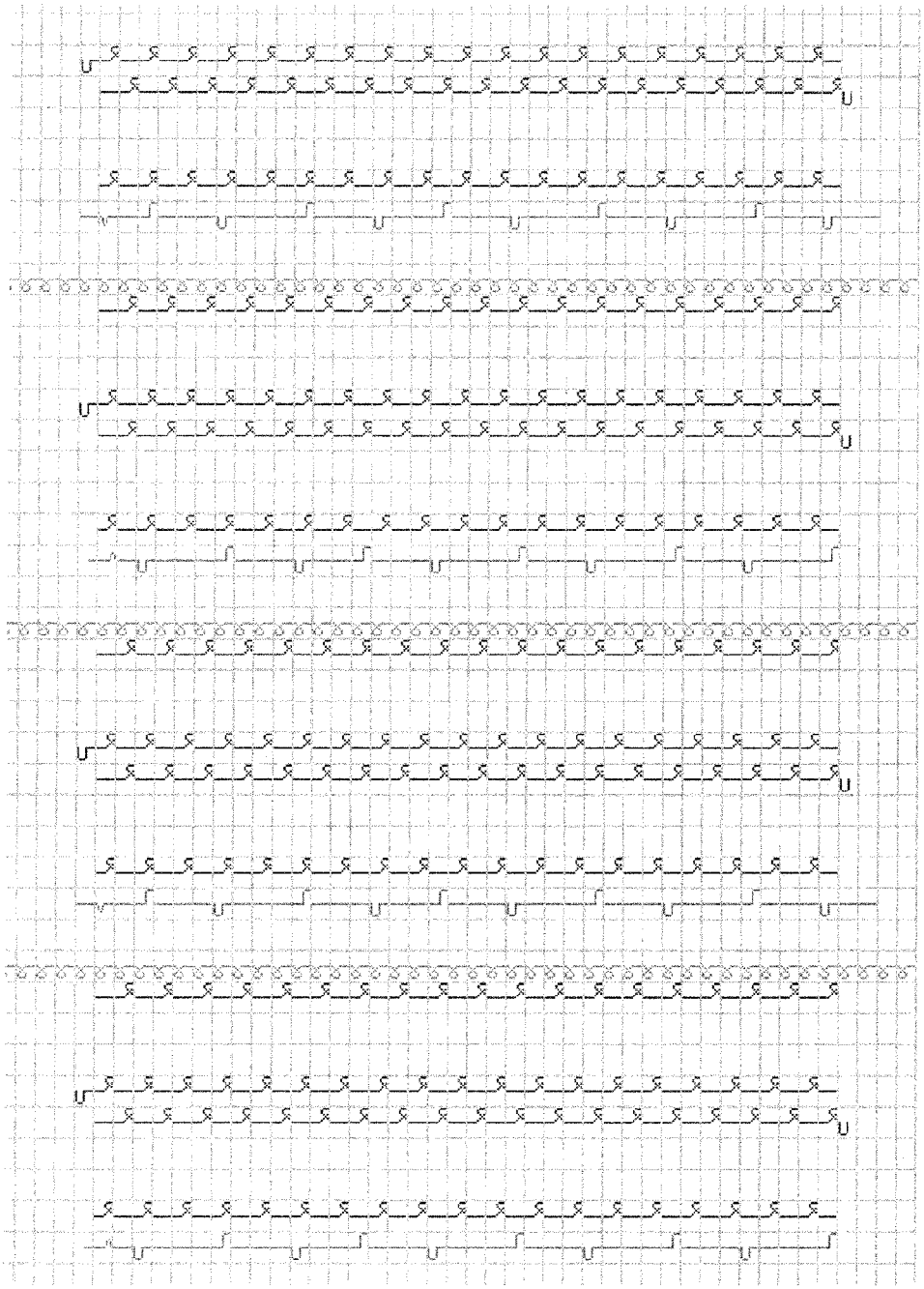
FIG. 10 is another exemplary schematic representation of a knitting sequence for a 3D textile electrode.

Various configurations for the stitching sequences are possible, such as using one out of every three needles or one out of every two needles for the tucking. In another example, the order of back needle tucks and front needle tucks may be reversed or varied such that they do not follow any type of random or non-random pattern. Similarly, while the illustrated knitting sequence suggests using four rows of conductive thread for every row of isolating thread, a 2:1 ratio or any other combination may also be used. FIG. 10 illustrates an alternative knitting sequence for an electrode.

In some embodiments, a garment will comprise more than one electrode and the electrodes will be positioned on the garment such that a single row of the garment, from one end to the other, may include more than one electrode at different positions of the electrode. For example, a given row may intersect a first electrode along row one while intersecting a second electrode along row ten and a third electrode along row twelve. The instructions sent to each needle along a needle bed will correspond to the appropriate position of each electrode. In an alternative embodiment, two electrodes are spaced apart and positioned at a same height within the garment.

Figure 11:
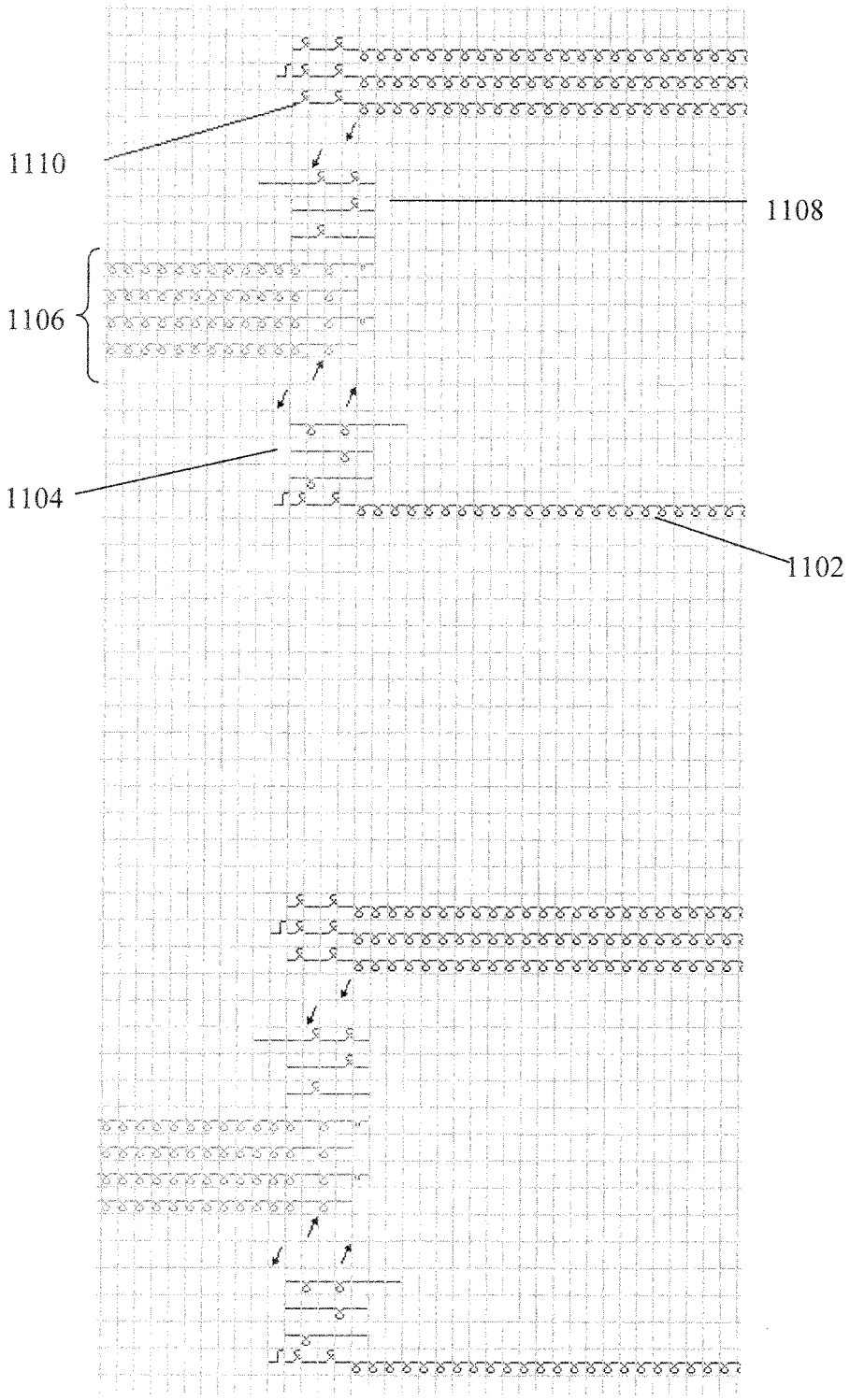
FIG. 11 is an exemplary schematic representation of a knitting sequence for a transmission channel.

FIG. 11 illustrates one possible knitting sequence for a transmission channel. In this embodiment, a series of events are repeated the length of the transmission channel. The isolating thread is knit along a row with front row stitches 1102 until a boundary between the base portion of the garment and the transmission channel. The row is continued on the back needle row with a pair of back needle stitches followed by a back tuck. The next series of rows correspond to the conductive thread inside the channel 1104. A few back row stitches are made on the conductive thread to give it more strength. The following sequence of rows represent the isolating thread being knit to form the tubular channel 1106 using front needle stitches. Another series of rows representing the conductive thread are shown at 1108, followed by another series of rows for the isolating thread. This sequence may be repeated a number of times to form the transmission channel.

Figure 12:
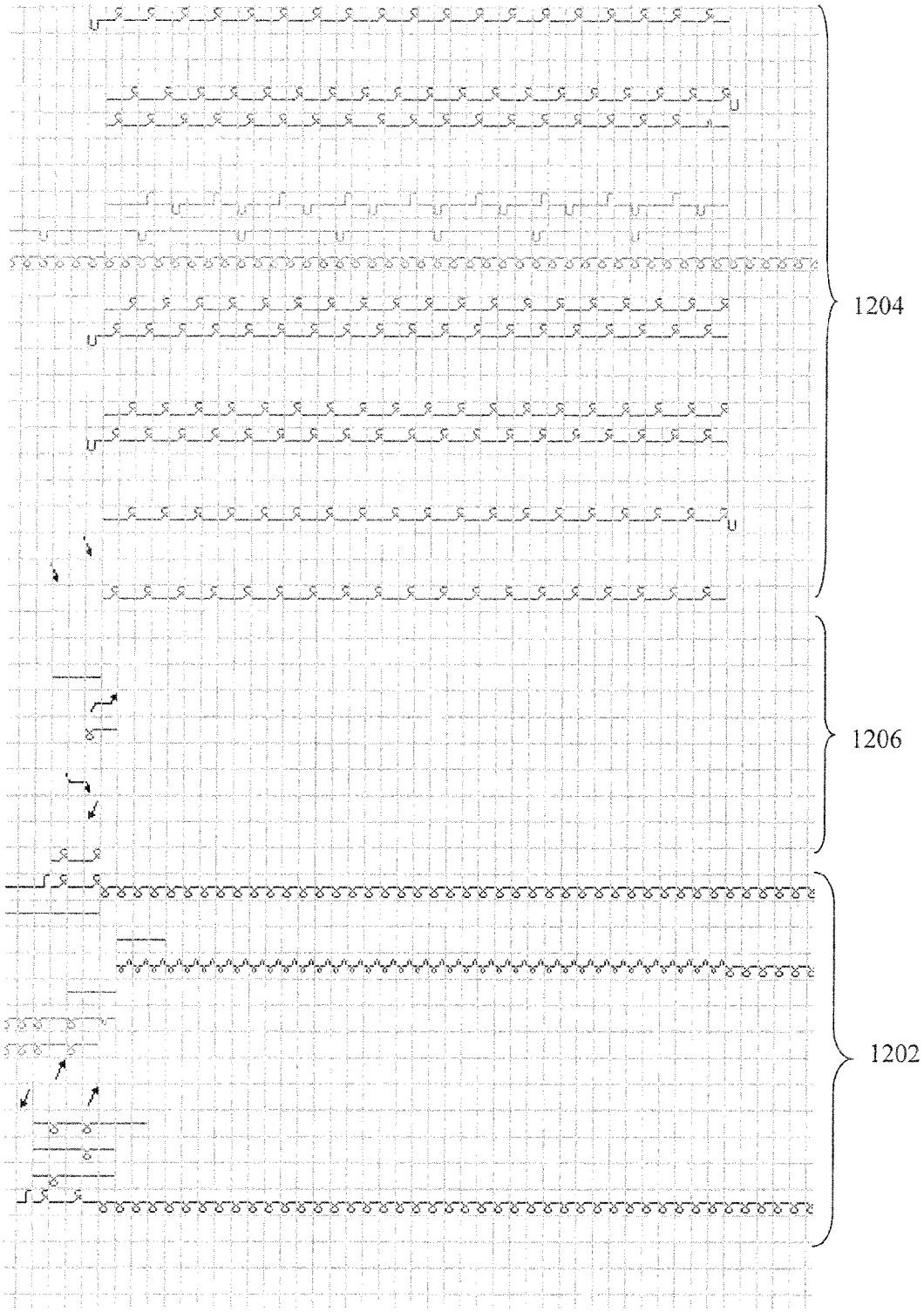
FIG. 12 is an exemplary schematic representation of a connection between a 3D textile electrode and a transmission channel.

FIG. 12 illustrates an exemplary knitting sequence for connecting the electrode to the transmission channel. The area identified by 1202 represents the transmission channel knitting sequence. The area identified by 1204 represents the electrode knitting sequence. The area identified by 1206 represents a series of transfers, pulls, tucks, and stitches performed on the conductive thread in order to transition between the transmission channel and the electrode. Alternative knitting sequences for this transition will be readily understood by those skilled in the art.

It should be noted that the present invention can be carried out as a method, can be embodied in a system, a computer readable medium or an electrical or electro-magnetic signal.

The embodiments of the invention described above are intended to be exemplary only. The scope of the invention is therefore intended to be limited solely by the scope of the appended claims.

The invention claimed is:

1. A method for knitting a garment having at least one three-dimensional textile electrode integrated therein, the method comprising:

knitting at least one tubular form;

knitting the at least one three-dimensional textile electrode integrally within the at least one tubular form by:

knitting a conductive surface composed of conductive thread;

knitting an isolating surface composed of isolating thread;

filling a space between the conductive surface and the isolating surface with a thread network; and sealing the electrode by connecting the conductive surface and the isolating surface together along a perimeter thereof; and knitting a textile transmission channel extending from the at least one three-dimensional textile electrode to transmit a measured signal.

2. The method of claim 1, wherein the tubular form, the at least one three-dimensional electrode, and the transmission channel are knit simultaneously.

3. The method of claim 1, wherein the tubular form, the at least one three-dimensional electrode, and the transmission channel are knit in a single, uninterrupted step.

4. The method of claim 1, wherein filling the space between the conductive surface and the isolating surface comprises depositing the thread network in the space using a tucking operation.

5. The method of claim 4, wherein depositing the thread network comprises depositing a monofilament yarn.

6. The method of claim 1, wherein knitting the textile transmission channel comprises:

extending a conductive thread from the conductive surface of the electrode; and knitting an isolating channel around the extended conductive thread so as to form the transmission channel.

7. The method of claim 1, wherein a first needle bed and a second needle bed of a machine are used to knit the conductive surface and the isolating surface and to fill the space therebetween simultaneously.

8. The method of claim 1, wherein knitting the at least one three-dimensional textile electrode comprises repeating a three event pattern, wherein a first event of the three event pattern comprises performing a sequence of back needle stitches along at least one row to knit the conductive surface;

wherein a second event of the three event pattern comprises performing a sequence of front needle stitches along the at least one row to knit the isolating surface; and wherein a third event of the three event pattern comprises performing a sequence of front and back needle tucks using a thread network to fill the space between the conductive surface and the isolating surface.

9. The method of claim 1, wherein knitting the transmission channel comprises:

knitting the isolating thread along at least one row with front row stitches until a boundary between the transmission channel and a base portion of the tubular form;

knitting at least one subsequent row with back row stitches for the conductive thread; and repeating the knitting of the isolating thread and the conductive thread to form the transmission channel.

10. The method of claim 1, wherein knitting the textile transmission channel extending from the at least one three-dimensional textile electrode comprises transitioning between the transmission channel and the electrode by performing a series of transfers, pulls, tucks, and stitches.

11. A garment having at least one three-dimensional textile electrode integrated therein, the garment comprising:

a base portion composed of at least one type of base thread;

at least one electrode portion defined by a perimeter and comprising:

a conductive surface on an inside of the garment for contact with skin of a wearer, the conductive surface composed of conductive thread;

an isolating surface on an outside of the garment composed of isolating thread; and an isolating thread network inside a space between the conductive surface and the isolating surface, the conductive surface and the isolating surface being sealed along the perimeter of the electrode portion; and a textile transmission channel extending from the at least one electrode portion to transmit a measured signal.

12. The garment of claim 11, wherein the transmission channel comprises an extended conductive thread and an isolating channel around the extended conductive thread and independent therefrom.

13. The garment of claim 12, wherein the isolating channel comprises a pair of opposing surfaces connected together along a pair of edges, with an open top end to receive the extended conductive thread and an open bottom end to allow the extended conductive thread to exit.

14. The garment of claim 12, wherein the extended conductive thread is stitched on itself.

15. The garment of claim 11, wherein the thread network comprises a deposited monofilament yarn.

16. The garment of claim 11 being selected from the group consisting of a sweater, a pair of pants, an underwear, a sock, a camisole, a mitten, a t-shirt, a pair of shorts, a vest, a jack-strap, a jacket and a brassiere.

17. The garment of claim 11, wherein the conductive thread is for capturing a signal associated with an electrical activity of a cell.

18. The garment of claim 11, further comprising a device integrated in the garment and connected to the textile transmission channel for interpreting the measured signal.

19. The garment of claim 18, wherein the device is a microprocessor with wireless transmission means.

20. A non-transitory computer readable medium comprising computer executable instructions for carrying out a method for knitting a garment having at least one three-dimensional textile electrode integrated therein, the method comprising:

instructing selected needles in a first needle bed and a second needle bed to knit at least one tubular form;

instructing selected needles in the first needle bed and the second needle bed to knit the at least one three-dimensional textile electrode integrally within the at least one tubular form by:

knitting a conductive surface composed of conductive thread using the first needle bed;

knitting an isolating surface composed of isolating thread using the second needle bed;

filling a space between the conductive surface and the isolating surface using a combination of the first needle bed and the second needle bed; and sealing the electrode by connecting the conductive surface and the isolating surface together along a perimeter of the electrode; and instructing selected needles in the first needle bed and the second needle bed to knit a textile transmission channel extending from the at least one three-dimensional textile electrode to transmit a measured signal.

21. The non-transitory, computer readable medium of claim 20, wherein the method further comprises instructing the selected needles in the first needle bed and the second needle bed to simultaneous knit the tubular form, the electrode, and the transmission channel.

* * * * *